US006238269B1

(12) United States Patent
Pollard et al.

(10) Patent No.: US 6,238,269 B1
(45) Date of Patent: May 29, 2001

(54) INK FEED SLOT FORMATION IN INK-JET PRINTHEADS

(75) Inventors: Jeffrey R. Pollard; Thomas E. Pettit, both of Corvallis; Shen Buswell, Monmouth; Nichole Godwin, Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/491,533

(22) Filed: Jan. 26, 2000

(51) Int. Cl.[7] ..... B24B 1/00

(52) U.S. Cl. ..... 451/36; 451/38; 451/39; 451/40; 451/41

(58) Field of Search ..... 451/36, 38, 39, 451/40, 41

(56) References Cited

U.S. PATENT DOCUMENTS 4,680,859 7/1987 Johnson .
4,730,197 * 3/1988 Raman et al. ..... 347/40
5,105,588 * 4/1992 Verley et al. ..... 451/38
5,387,314 2/1995 Baugnman .
5,441,593 8/1995 Baughman .
5,608,436 3/1997 Baughman .
5,658,471 8/1997 Murthy .
5,681,764 10/1997 Hess .
5,860,202 * 1/1999 Okawa et al. ..... 451/36

* cited by examiner

*Primary Examiner*—M. Rachuba

(57) ABSTRACT

A technique for controlling the abrasive jet machining process to drill an ink feed slot through an ink jet printhead substrate. The approach results in a relatively even slot edge adjacent to channels that supply the ink-droplet firing chambers of the printhead. The evenness of the edge reduces the tolerances required for designing the channels and other printhead components, thus permitting the construction of printheads with increased droplet ejection frequency. The printhead size is correspondingly reduced.

17 Claims, 2 Drawing Sheets

INK FEED SLOT FORMATION IN INK-JET PRINTHEADS

TECHNICAL FIELD

This invention relates to the construction of thermal ink-jet printheads.

BACKGROUND AND SUMMARY OF THE INVENTION

A typical ink-jet printer includes one or more cartridges that contain a reservoir of ink. The reservoir is connected to a printhead that is mounted to the body of the cartridge.

The printhead is controlled for ejecting minute droplets of ink from the printhead to a printing medium, such as paper, that is advanced through the printer. The ejection of the droplets is controlled so that the droplets form images on the paper.

The printhead includes a substrate, which is a conventional silicon wafer upon which has been grown a dielectric layer, such as silicon dioxide. The ink droplets are ejected from small ink chambers carried on the substrate. The chambers (designated "firing chambers") are formed in a component known as a barrier layer. The barrier layer is made from photosensitive material that is laminated onto the printhead substrate and then exposed, developed, and cured in a configuration that defines the firing chambers.

The primary mechanism for ejecting a droplet is a heat transducer, such as a thin-film resistor. The resistor is carried on the printhead substrate. The resistor is covered with suitable passivation and other layers, as is known in the prior art, and connected to conductive layers that transmit current pulses for heating the resistors. One resistor is located in each of the firing chambers.

In a typical printhead, the ink droplets are ejected through orifices that are formed in an orifice plate that covers most of the printhead. The orifice plate may be electroformed with nickel and coated with a precious metal for corrosion resistance. Alternatively, the orifice plate is made from a laser-ablated polyimide material. The orifice plate is bonded to the barrier layer and aligned so that each firing chamber is continuous with one of the orifices.

The firing chambers are refilled with ink after each droplet is ejected. In this regard, each chamber is continuous with an ink channel that is formed in the barrier layer. The channels extend toward an elongated ink feed slot that is formed through the substrate. The ink feed slot may be located in the center of the printhead with firing chambers located on opposite long sides of the feed slot. The slot is made after the ink-ejecting components (except for the orifice plate) are formed on the substrate.

The just mentioned components (barrier layer, resistors, etc) for ejecting the ink drops are mounted to the front side of the printhead substrate. The back side of the printhead is mounted to the body of the ink cartridge so that the ink slot is in fluid communication with an opening to the reservoir. Thus, refill ink flows through the ink feed slot from the back side of the substrate toward the front of the substrate and then across the front side through the channels (and beneath the orifice plate) to refill the chambers.

One prior method of forming the ink feed slot in the substrate involved abrasive jet machining as described in U.S. Pat. No. 5,105,588, hereby incorporated by reference. This prior approach uses compressed air to force a stream of very fine particles (such as aluminum oxide grit) to impinge on the substrate for a time sufficient for the slot to be formed.

This abrasive jet machining is often referred to as drilling or sandblasting. In prior the art, the nozzle from which the particles are emitted is spaced a short distance from the back of the substrate during the entire drilling process.

The portion of the front side of the substrate between the slot and the ink channels is known as the printhead "shelf." Preferably this shelf length is designed to be as short as possible because as the length of the shelf increases (i.e., the distance the ink must flow from the slot to enter the ink channels) there is an attendant decrease in the frequency with which ink droplets may be ejected from the firing chambers.

The edge defined by the junction of the slot and the shelf is designated as the shelf edge. Prior approaches to forming the ink feed slot by abrasive jet machining as described above produced uneven shelf edges. Thus, the length of the shelf had to be designed with significant tolerances to account for the uneven shelf edge.

The present invention is directed to a technique for controlling the abrasive jet machining process to drill an ink feed slot that results in a relatively even shelf edge. The evenness of the shelf edge reduces the tolerances required for designing the shelf length, thus permitting the construction of printheads with minimized shelf lengths and a correspondingly increased droplet ejection frequency. The printhead size is correspondingly reduced.

As another aspect of this invention, the characteristic taper in the width of the slot (that is, the drilled slot widens from the front side to the back side of the substrate as a result of the abrasive-jet machining process) is dramatically reduced. These reduced-taper ink feed slots are particularly advantageous in printhead designs with multiple feed slots since more slots may be accommodated on a given size substrate than is possible with slots using the prior approach.

Other advantages and features of the present invention will become clear upon study of the following portion of this specification and the drawings.

DETAILED DESCRIPTION OF PREFERRED EMBODIMENTS

Figure 1:
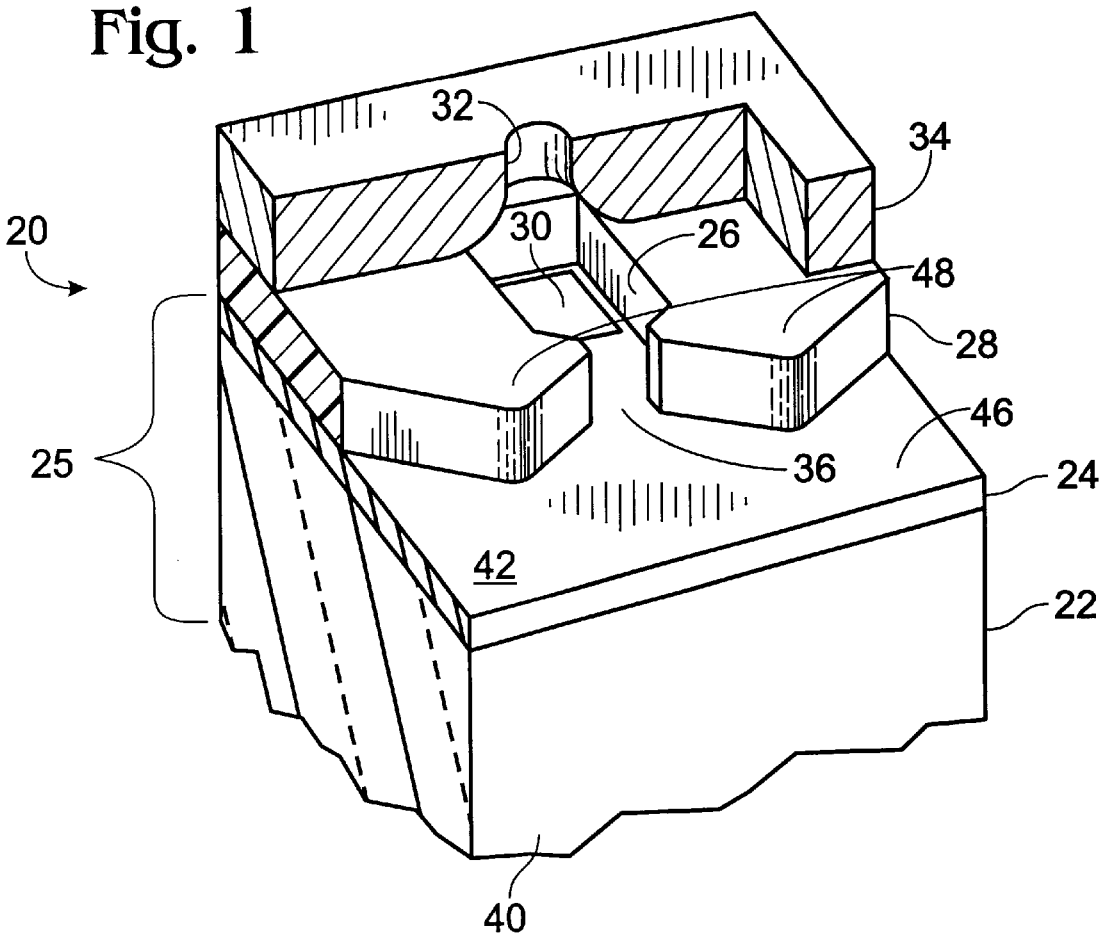
FIG. 1 is a perspective cutaway view of a piece of a printhead, showing the primary components for ejecting ink, including part of an ink feed slot.

With reference to FIG. 1, the primary components of a printhead 20 are formed on a conventional silicon wafer 22 upon which has been grown a dielectric layer, such as silicon dioxide 24. Hereafter, the term substrate 25 will be considered as including the wafer and dielectric layers. A number of printhead substrates may be simultaneously made on a single wafer, the dies of which each carry individual printheads.

The ink droplets are ejected from small ink chambers carried on the substrate. The chambers (designated "firing chambers" 26) are formed in a barrier layer 28, which is made from photosensitive material that is laminated onto the printhead substrate and then exposed, developed, and cured in a configuration that defines the firing chambers.

The primary mechanism for ejecting an ink droplet from a firing chamber is a thin-film resistor 30. The resistor 30 is carried on the printhead substrate 25. The resistor 30 is covered with suitable passivation and other layers, as is known in the prior art, and connected to conductive layers that transmit current pulses for heating the resistors. One resistor is located in each of the firing chambers 26.

In a typical printhead, the ink droplets are ejected through orifices 32 (one orifice shown cut away in FIG. 1) that are formed in an orifice plate 34 that covers most of the printhead. The orifice plate 34 may be made from a laser-ablated polyimide material. The orifice plate 34 is bonded to the barrier layer 28 and aligned so that each firing chamber 26 is continuous with one of the orifices 32 from which the ink droplets are ejected.

Figure 2:
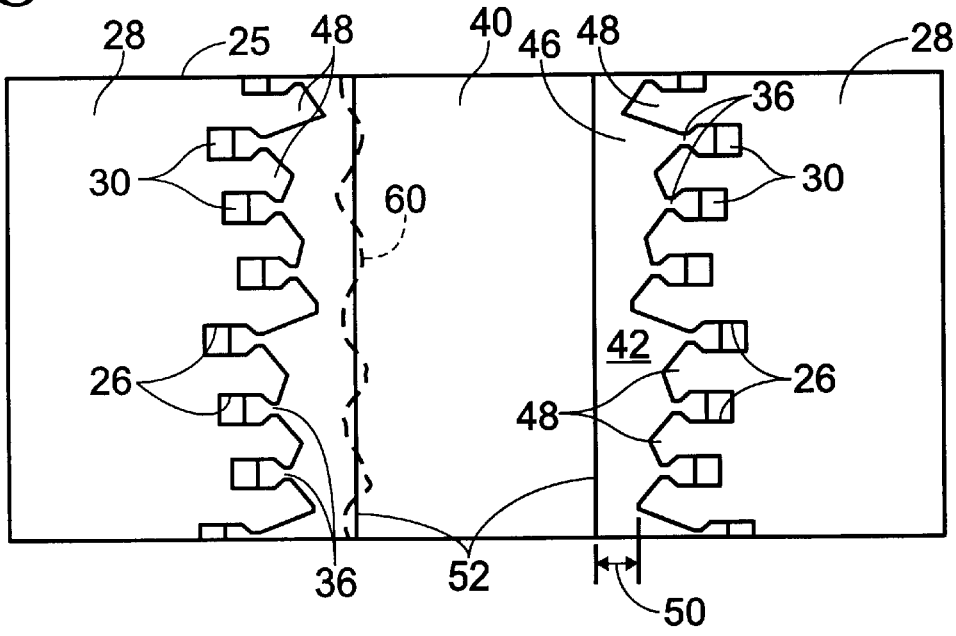
FIG. 2 is a top plan view of the front side of a portion of a printhead substrate and ink ejecting components, except for the orifice plate, which is omitted for clarity.

The firing chambers 26 are refilled with ink after each droplet is ejected. In this regard, each chamber is continuous with a channel 36 that is formed in the barrier layer 28. The channels 36 extend toward an elongated ink feed slot 40 that is formed through the substrate. The ink feed slot 40 may be centered between rows of firing chambers 26 that are located on opposite long sides of the ink feed slot 40. The slot 40 is made after the ink-ejecting components (except for the orifice plate 34) are formed on the substrate (FIG. 2).

The just mentioned components (barrier layer 28, resistors 30, etc) for ejecting the ink drops are mounted to the front side 42 of the substrate 25. The back side 44 (FIG. 4) of the printhead is mounted to the body of an ink cartridge so that the ink slot 40 is in fluid communication with openings to the reservoir. Thus, refill ink flows through the ink feed slot 40 from the back side 44 toward the front side 42 of the substrate 25. The ink then flows across the front side 42 (that is, to and through the channels 36 and beneath the orifice plate 34) to fill the chambers 26.

As mentioned above, the portion of the front side 42 of the substrate 25 between the slot 40 and the ink channels 36 is known as a shelf 46. The portions of the barrier layer 28 nearest the ink slot 40 are shaped into lead-in lobes 48 that generally serve to separate one channel 36 from an adjacent channel. The lobes define surfaces that direct ink flowing from the slot 40 across the shelf 46 into the channels 36. Examples of lead-in lobes 48 and channel shapes are shown in the figures. Those shapes form no part of the present invention.

The shelf length 50 (FIG. 2) can be considered as the distance from the edge 52 of the slot 40 (at the substrate front side 42) and the nearest part of the lead-in lobes 48. As noted, it is preferred that this shelf length be as short as possible because the droplet ejection frequency decreases as the length of the shelf increases (i.e., the distance the ink must flow from the slot to enter the ink channels).

The shelf edge 52 of a slot formed in accordance with the present invention is dramatically more uniform than such edges formed by prior art abrasive jet machining. For illustration of this point an edge formed by the prior art technique is depicted at dashed lines 60 on one side of the slot 40 (FIG. 2).

Figure 3:
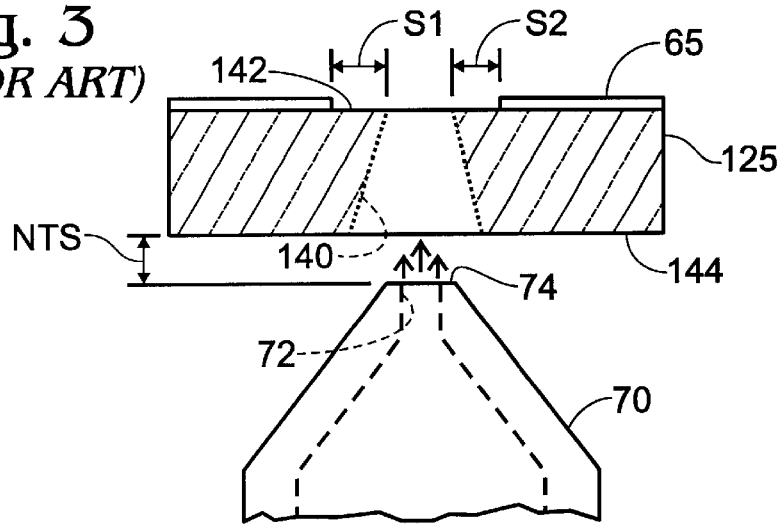
Fig. 3 (PRIOR ART)
FIG. 3 is a diagram of a prior art approach to forming an ink feed slot using abrasive jet machining.

FIG. 3 is a diagram of a prior art approach to forming an ink feed slot 140 using abrasive jet machining. (The above described ink ejecting components such as barrier layer, resistors etc., are shown for simplicity as a single layer 65 in the diagrams of FIGS. 3–5.) The planar back side 144 of the substrate 125 faces a nozzle 70. A bore 72 in the nozzle 70 terminates at the outermost, flat face 74 of the nozzle. As seen from a viewpoint perpendicular to the face 74 of the nozzle, the shape of the bore 72 generally matches the elongated, rectangular shape of the slot 40.

The distance between the nozzle face 74 and the back side 144 of the substrate is the nozzle-to-substrate (NTS) distance. In the past, this distance has been established at about 2 millimeters and maintained throughout the time the ink feed slot was drilled.

The bore 72 is connected to a supply of compressed air and very fine abrasive particulates, such as aluminum oxide grit. A stream of the abrasive particles, propelled by the pressurized air, impinges on the substrate and erodes that material until the entire slot is formed from the back side 144 through the front side 142 of the substrate 125.

As noted earlier, the slot 140 formed by the prior art process has a somewhat irregular or uneven shelf edge 60 (FIG. 2). As a result, at any given section in the slot, the length of the shelf (measured as described above) may vary such as illustrated at S1 and S2 in FIG. 3 (S2 being shorter). This unevenness leads to the requirement for large tolerances and shelf lengths as discussed above.

It is also noteworthy the prior art approach produces a slot that includes a large taper from the back side 144 to the front side 142 of the substrate. Put another way, the slot width at the back side 144 is considerably wider than at the front side 142. In a wafer of 0.670 mm thickness, the conventional slot 140 having a 0.300 mm width as measured at the front side may have a width as large as 0.750 mm or more as measured at the back side 144 of the substrate, a 20-degree taper.

The abrasive jet machining technique of the present invention commences (FIG. 4) with the face 74 of the nozzle located at an NTS distance of greater than zero for drilling some of the ink feed slot 40 and then moved to an NTS distance of zero (FIG. 5) for drilling the remainder of the slot. This approach produces a very even slot edge 52, hence a more predictable shelf length. This approach also produces a slot having a much smaller taper (through the substrate) than is possible with prior abrasive jet machining methods.

Figure 4:
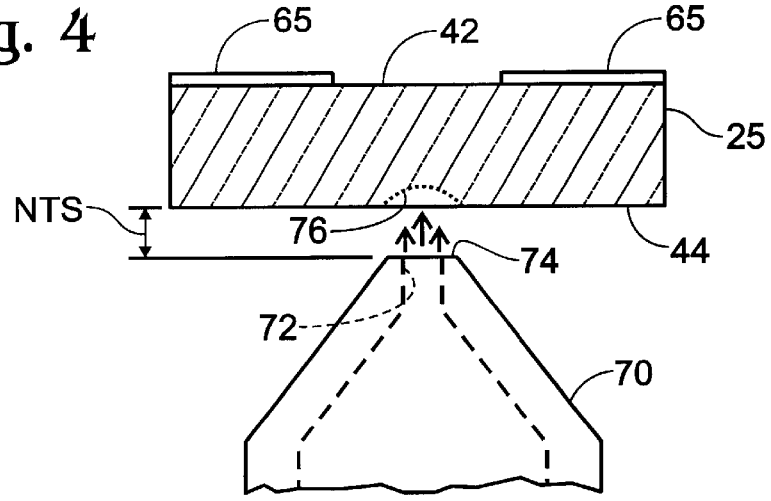
FIG. 4 is a diagram illustrating an initial step in a preferred method for forming the ink feed slot in accordance with the present invention.

More particularly, the nozzle face 74 is located at the initial NTS distance by, for example, a precisely controlled stepper motor or linear actuator, the stream of compressed air and particulates, such as such as aluminum oxide grit, is emitted from the nozzle to impinge upon the back face 44 of the substrate (FIG. 4). In a preferred embodiment, this initial NTS distance is selected to by about 2.0 mm. Preferably, the air pressure that delivers the particulates is in the range of 700–950 kPa. The average size of the particulates sizes should be about 0.025 mm.

It is contemplated that this initial NTS distance may be selected to be within a range of distances. For instance, the initial NTS distance may be selected to be shorter in instances where a lower air pressure is selected. In any event, the speed with which the slot is drilled is increased by selecting an initial NTS distance of greater than zero (and drilling for a short time) before moving the nozzle face 74 into the same plane as the back side 44 of the substrate to complete drilling the slot.

Figure 5:
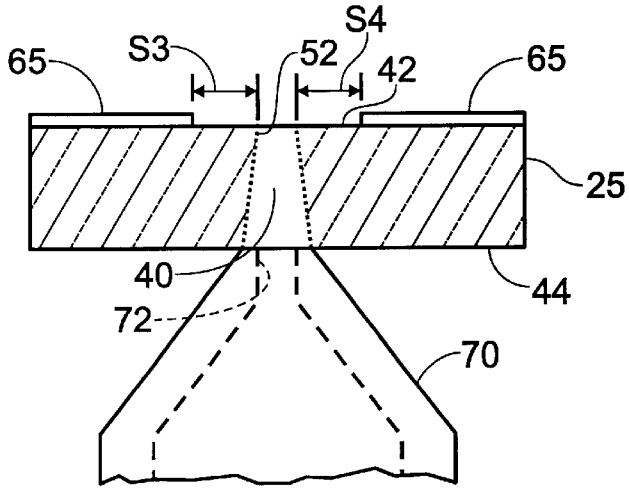
FIG. 5 is a diagram illustrating a final step in a preferred method for forming the ink feed slot in accordance with the present invention.

As shown in FIG. 4, the spaced, initial NTS distance is maintained until an initial divot portion 76 of the slot is made in the back side 44 of the substrate 25. This divot permits escape of the particulate stream once the nozzle face is moved into the plane of the back side 44 (FIG. 5). In one preferred embodiment, the nozzle 70 is held at the initial NTS distance for a relatively short time, such as 1.5 seconds, which corresponds to about 25% of the time required to completely drill the slot 40 in accordance with the present invention.

After the initial drilling period, the nozzle is moved (or alternatively, the substrate is moved relative to the nozzle) until the nozzle face is in the plane of the back side 44 of the substrate, and the drilling continues until the slot 40 is completely opened into the front side 42 of the substrate. In a preferred embodiment, this takes about 4.5 seconds (about 75% of the overall drilling time).

The preferred method can be considered as a varying NTS approach to abrasive jet machining of ink feed slots, whereas prior approaches held the NTS at a fixed value for drilling the slot. In one preferred embodiment, the stream of abrasive particulates is stopped while the NTS distance is changed from the initial (FIG. 4) to the final (FIG. 5). Alternatively, the stream may be maintained while the nozzle is so moved.

As noted, the abrasive jet machining technique of the present invention produces a very even slot edge 52; hence, a more predictable shelf length. That is, at any given section of the slot, the shelf lengths (shown as S3 and S4 in FIG. 5) are substantially equal, thereby reducing the tolerances required when designing shelf lengths.

As also noted earlier, the slot 40 formed in accordance with the present invention has relatively little taper from the front surface 42 to the back surface 44 of the substrate 25. The width of the slot at the back surface of the substrate is less than twice the width of the slot at the front surface. In a preferred embodiment as just described, using a wafer of 0.670 mm thickness, a slot 40 having a 0.280 mm width as measured at the front side will have a width of about 0.470 mm or less as measured at the back side 44 of the substrate, an 8-degree taper.

While the present invention has been described in terms of preferred embodiments, it will be appreciated by one of ordinary skill that the spirit and scope of the invention is not limited to those embodiments, but extend to the various modifications and equivalents as defined in the appended claims. For instance, a slot having the advantageous characteristics (narrow taper and even shelf edges) may be formed by undertaking the entire drilling process with the nozzle face in the plane of the back side of the substrate (i.e., the position of the nozzle as shown in FIG. 5). This approach, however, will generally increase the drilling time as compared to the other inventive approach described above.

What is claimed is:

1. A method of controlling abrasive jet machining to form a slot through a silicon substrate that has a planar back surface, wherein the nozzle has a bore that terminates at an outer face of the nozzle and from which bore flows a stream of abrasive particles, the method comprising the steps of:

locating the outer face of the nozzle at a first distance spaced from the back surface of the substrate;

directing the stream of abrasive particles against the substrate while the nozzle outer face is located at the first distance; then positioning the outer face of the nozzle at a second distance that is less than the first distance; and directing the stream of abrasive particles against the substrate while the nozzle outer face is located at the second distance.

2. The method of claim 1 including the step of selecting the second distance such that the outer face of the nozzle is substantially in the plane of the back surface.

3. The method of claim 1 wherein the steps of directing the stream of abrasive particles against the substrate are carried out for a drilling time that is sufficient for forming a slot through the substrate and so that most of the drilling time occurs while the outer face of the nozzle is in the second position.

4. The method of claim 1 wherein the step of directing the stream of abrasive particles against the substrate while the nozzle outer face is located at the first distance is carried out for less than 2 seconds.

5. The method of claim 4 wherein the step of directing the stream of abrasive particles against the substrate while the nozzle outer face is located at the second distance is carried out for less than 5 seconds.

6. The method of claim 3 wherein the stated most of the drilling time is about seventy-five percent of the drilling time.

7. The method of claim 1 wherein the first distance is about 2.0 millimeters.

8. The method of claim 1 wherein the substrate is a silicon wafer.

9. A method of making a slot through a silicon substrate that has a planar back surface, comprising the steps of:

providing a nozzle that has a bore and an outer face and through which bore a stream of abrasive particles is propelled from the outer face;

moving the outer face of the nozzle to the plane of the back surface of the substrate; and directing through the nozzle a stream of abrasive particles.

10. The method of claim 9 wherein the substrate has a front surface, and the slot has a width, the method including the step of shaping the slot in the substrate so that the width of the slot at the back surface of the substrate is less than twice the width of the slot at the front surface.

11. The method of claim 9 wherein the directing step occurs during the moving step.

12. The method of claim 9 wherein the directing step occurs after the outer face of the nozzle is moved to the plane of the back surface.

13. The method of claim 11 wherein the moving step is completed within about 2 seconds after commencement of the directing step.

14. The method of claim 9 wherein the moving step is preceded by the steps of:

locating the outer face of the nozzle at a beginning distance spaced from the back surface of the substrate; and directing through the nozzle a stream of abrasive particles while the nozzle is located at the beginning distance.

15. The method of claim 14 wherein the slot is made through the silicon substrate as a result of the abrasion of the particles against the substrate and wherein the nozzle outer face is located in the plane of the planar back surface of the substrate for most of the time required to make the slot.

16. The method of claim 14 including the step of drilling completely through the substrate in about 6 seconds using the stream of abrasive particles.

17. The method of claim 14 wherein the directing steps are stopped during the moving steps.

* * * * *